US006995512B2

(12) United States Patent
Otani

(10) Patent No.: US 6,995,512 B2
(45) Date of Patent: Feb. 7, 2006

(54) PLASMA DISPLAY PANEL

(75) Inventor: Eishiro Otani, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 107 days.

(21) Appl. No.: 10/796,137

(22) Filed: Mar. 10, 2004

(65) Prior Publication Data

US 2004/0189550 A1 Sep. 30, 2004

(30) Foreign Application Priority Data

Mar. 24, 2003 (JP) ..... 2003-080179

(51) Int. Cl.
*H01J 17/49* (2006.01)

(52) U.S. Cl. ..... 313/587; 313/585; 313/586

(58) Field of Classification Search ..... 313/581–587; 315/169.4; 345/41, 60
See application file for complete search history.

(56) References Cited

U.S. PATENT DOCUMENTS 6,288,488 B1 * 9/2001 Amemiya ..... 313/582
6,344,715 B2 * 2/2002 Tokunaga et al. ..... 315/169.4
6,486,611 B2 * 11/2002 Tokunaga et al. ..... 315/169.4
6,674,238 B2 * 1/2004 Otani et al. ..... 313/587
6,703,782 B2 * 3/2004 Otani et al. ..... 313/585
6,876,340 B2 * 4/2005 Kobayashi ..... 345/60
2001/0011869 A1 * 8/2001 Nakajima et al. ..... 313/586
2001/0011871 A1 * 8/2001 Amemiya et al. ..... 313/586

FOREIGN PATENT DOCUMENTS

JP 9-167565 6/1997

* cited by examiner

*Primary Examiner*—Ashok Patel
(74) *Attorney, Agent, or Firm*—McGinn IP Law Group, PLLC

(57) ABSTRACT

A partition wall defines individual discharge cells. A second lateral wall partitions each of the discharge cells into a display discharge cell opposing two transparent electrodes of the paired row electrodes and allowing for a sustain discharge, and an addressing discharge cell opposing a bus electrode of one of the paired row electrodes and allowing for an addressing discharge produced between the bus electrode and a column electrode. A clearance is provided between the display discharge cell and the addressing discharge cell to establish communication from the addressing discharge cell to the display discharge cell. A high γ material layer is provided on an area facing the addressing discharge cell.

10 Claims, 6 Drawing Sheets

SECTION V1-V1

SECTION V-V

SECTION W-W

SECTION V1-V1

SECTION V2-V2

SECTION W1-W1

PLASMA DISPLAY PANEL

BACKGROUND OF THE INVENTION

1. Field of the Invention

This invention relates to a panel structure for surface-discharge-type AC plasma display panels.

The present application claims priority from Japanese Application No. 2003-80179, the disclosure of which is incorporated herein by reference.

2. Description of the Related Art

Surface-discharge-type AC plasma display panels have recently gained the spotlight as types of large-sized slim color display apparatus and are becoming increasingly common in homes and the like.

FIGS. 1 to 3 are schematically structural diagrams of the conventional surface-discharge-type AC plasma display panels, FIG. 1 being a front view, FIG. 2 being a sectional view taken along the V—V line in FIG. 1 and FIG. 3 being a sectional view taken along the W—W line in FIG. 1.

Referring to FIGS. 1 to 3, the plasma display panel (hereinafter referred to as "PDP") has a front glass substrate 1 of which one surface serves as the display screen and on the other surface are formed in order a plurality of row electrode pairs (X, Y), a dielectric layer 2 covering the row electrode pairs (X, Y) and an MgO made protective layer 3 covering the back surface of the dielectric layer 2.

The row electrodes X, Y are individually composed of transparent electrodes Xa, Ya each formed of a large-wide-shaped transparent conductive film made of ITO or the like, and bus electrodes Xb, Yb each formed of a small-wide-shaped metal film assisting the conductivity of the corresponding transparent electrode.

The row electrodes X and Y are arranged in alternate positions in the column direction (i.e. the vertical direction in FIG. 1). The adjacent two row electrodes X, Y in this arrangement face each other with a discharge gap gin between to constitute a row electrode pair (X, Y) forming a display line L in matrix display.

The front glass substrate 1 is opposite a back glass substrate 4 with a discharge-gas-filled discharge space S in between. On the inner surface of the back glass substrate 4 opposing the front glass substrate 1, a plurality of column electrodes D each extending in a direction at right angles to the row electrode pairs (X, Y) are regularly arranged. A belt-shaped partition wall 5 extends in parallel between the adjacent column electrodes D. Further phosphor layers 6 individually made of red (R), green (G), and blue (B) phosphor materials each cover the side faces of the partition walls 5 and the column electrode D between the partition wall 5 concerned.

In each display line L, the partition walls 5 delimit the discharge space S at intersections of the column electrodes D and the row electrode pair (X, Y) to define discharge cells C each forming a unit light-emitting area.

The PDP having the foregoing structure is described in Japanese Patent Laid-open Application No. 9-167565.

The surface-discharge-type AC plasma display panel displays images as follows:

In an addressing period subsequent to a reset period for causing a reset discharge, a discharge (addressing discharge) is caused between the column electrode D and one row electrode in the row electrode pair (X, Y) (in this case, the row electrode Y) in each of the selected discharge cells C. As a result, the lighted cells (the discharge cells having wall charges generated on the dielectric layer 2) and the non-lighted cells (the discharge cells having no wall charges generated on the dielectric layer 2) are distributed over the panel surface in accordance with the image to be displayed.

After completion of the addressing period, simultaneously in all the display lines L, a discharge-sustaining pulse is applied alternately to the row electrodes X and Y in each row electrode pair. Thereupon, due to the wall charges accumulated on the dielectric layer 2, a sustain discharge is produced between the row electrodes X and Y in each lighted cell with every application of the discharge-sustaining pulse.

As a result of the sustain discharge in each lighted cell, ultraviolet light is generated and excites each of the red-, green- and blue-colored phosphor layers 6 in the individual discharge cells C to emit visible light for the generation of the image.

In the conventional three-electrode surface-discharge-type AC PDPs structured as described above, the addressing discharge and the sustain discharge are caused in the same discharge cell C. That is, the addressing discharge produced in each discharge cell C passes through the red (R), green (G), or blue (B) phosphor layer 6 which is formed for emitting colored light by means of the sustain discharge produced in the discharge cell C concerned.

Under these circumstances, the addressing discharge caused in each discharge cell C is affected by elements in the phosphor layer 6 such as discharge properties varying with each color of the phosphor material forming the phosphor layer 6, variations in the layer thickness produced in the forming process for the phosphor layer 6, and the like. Therefore, the conventional PDPs have the problem of significant difficulty in providing the equivalent addressing-discharge properties in each discharge cell C.

In order for the foregoing conventional three-electrode surface-discharge-type AC PDPs to increase the surface area of the phosphor layer 6 for an increase in luminous efficiency, there is a need to expand the discharge space inside each discharge cell C. To meet this need, the method of increasing the height of the partition wall 5 has been conventionally employed.

However, increasing the height of the partition wall 5 for an increase in luminous efficiency results in an increase in the distance between the row electrode Y and the column electrode D in which the addressing discharge is produced, leading to the problem of needing to boost the voltage for starting the addressing discharge.

SUMMARY OF THE INVENTION

The present invention is mainly designed to solve the problems associated with the conventional surface-discharge-type AC plasma display panels as described hitherto.

It is, therefore, an object of the present invention to improve luminous efficiency without the need to boost the starting voltage for an addressing discharge.

To achieve this object, the present invention provides a plasma display panel including: a front substrate having an inner face and a back substrate having an inner face opposing the inner face of the front substrate with a discharge space in between; a plurality of row electrode pairs extending in a row direction and regularly arranged in a column direction to form display lines on the inner face of the front substrate; a dielectric layer covering the row electrode pairs on the inner face of the front substrate; a protective layer covering the dielectric layer on the inner face of the front substrate; a plurality of column electrodes extending in the column direction and regularly arranged in the row direction to intersect with the row electrode pairs; a partition wall having dividing walls; unit light-emission areas formed at the intersections of the row electrode pairs and the column electrodes in the discharge space, and each defined by the partition wall, and each partitioned by the dividing wall into a first discharge area facing mutually opposing portions of the row electrodes constituting each of the row electrode pairs and providing for a discharge produced between the row electrodes, and a second discharge area facing a portion of one row electrode in the row electrode pair initiating a discharge in association with the column electrode and providing for the discharge produced between the column electrode and the portion of the one row electrode; a communicating element provided between the first discharge area and the second discharge area for communication from the second discharge area to the first discharge area; and a secondary electron emissive layer formed of a material of a coefficient of secondary electron emission higher than that of the protective layer and provided on a portion of an inner face of the dielectric layer facing the second discharge area.

In this plasma display panel, first, a reset discharge is caused in each of the first discharge areas for the generation of an image.

At this point, a discharge is produced between the column electrode and a portion of one row electrode constituting the row electrode pair in the second discharge area. The discharge induces the generation of ultraviolet light from a discharge gas. The ultraviolet light excites the secondary electron emissive layer formed on a portion of the inner face of the dielectric layer facing the second discharge. As a result, an abundance of secondary electrons is released from the secondary electron emissive layer into the second discharge area.

Next, an addressing discharge is produced between the column electrode and one row electrode in the row electrode pair in the second discharge area. Charged particles generated through the discharge in the second discharge area flow into the first discharge area through the communicating element provided between the second discharge area and the first discharge area. Thus, the first discharge areas having wall charges (lighted cells) and the first discharge areas having no wall charges (non-lighted cells) are distributed over the panel surface in accordance with the image to be generated.

In the production of this addressing discharge, secondary electrons have been released from the secondary electron emissive layer into the second discharge area because of the immediately preceding discharge caused in the second discharge area. The secondary electrons have the effect of lowering the voltage for starting the addressing discharge, resulting in the achievement of producing an addressing discharge at high speed at low voltage.

According to the present invention, thus, the plasma display panel is capable of offering stable discharge properties in the addressing discharge. This is because the addressing discharge for distributing unit light-emission areas having wall charges and unit light-emission areas having no wall charges over the panel surface is caused in the second discharge area formed independently of the first discharge area from which, visible light is emitted for the generation of images.

Further, the secondary electron emissive layer is provided facing toward the second discharge area and formed of a material of a coefficient of secondary electron emission higher than that of the protective layer covering the dielectric layer. For this reason, an abundance of secondary electrons is released from the secondary electron emissive layer into the second discharge area through the discharge which is caused in the second discharge area prior to the addressing discharge, thereby ensuring the necessary amount of secondary electrons (priming particles) for producing the addressing discharge. The secondary electrons thus adequately ensured have the effect of lowering the voltage required for starting the addressing discharge and therefore make it possible to produce an addressing discharge at low voltage at high speed.

Still further, the secondary electron emissive layer faces the second discharge area in which visible light is not generated for the generation of images. Therefore, light transmittance through the secondary electron emissive layer presents no problem. The selection of materials for the secondary electron emissive layer is not subject to the constraints of the light transmittance of the materials.

These and other objects and features of the present invention will become more apparent from the following detailed description with reference to the accompanying drawings.

DETAILED DESCRIPTION OF THE PREFERRED EMBODIMENT

A preferred embodiment according to the present invention will be described below in detail with reference to the accompanying drawings.

Figure 1:
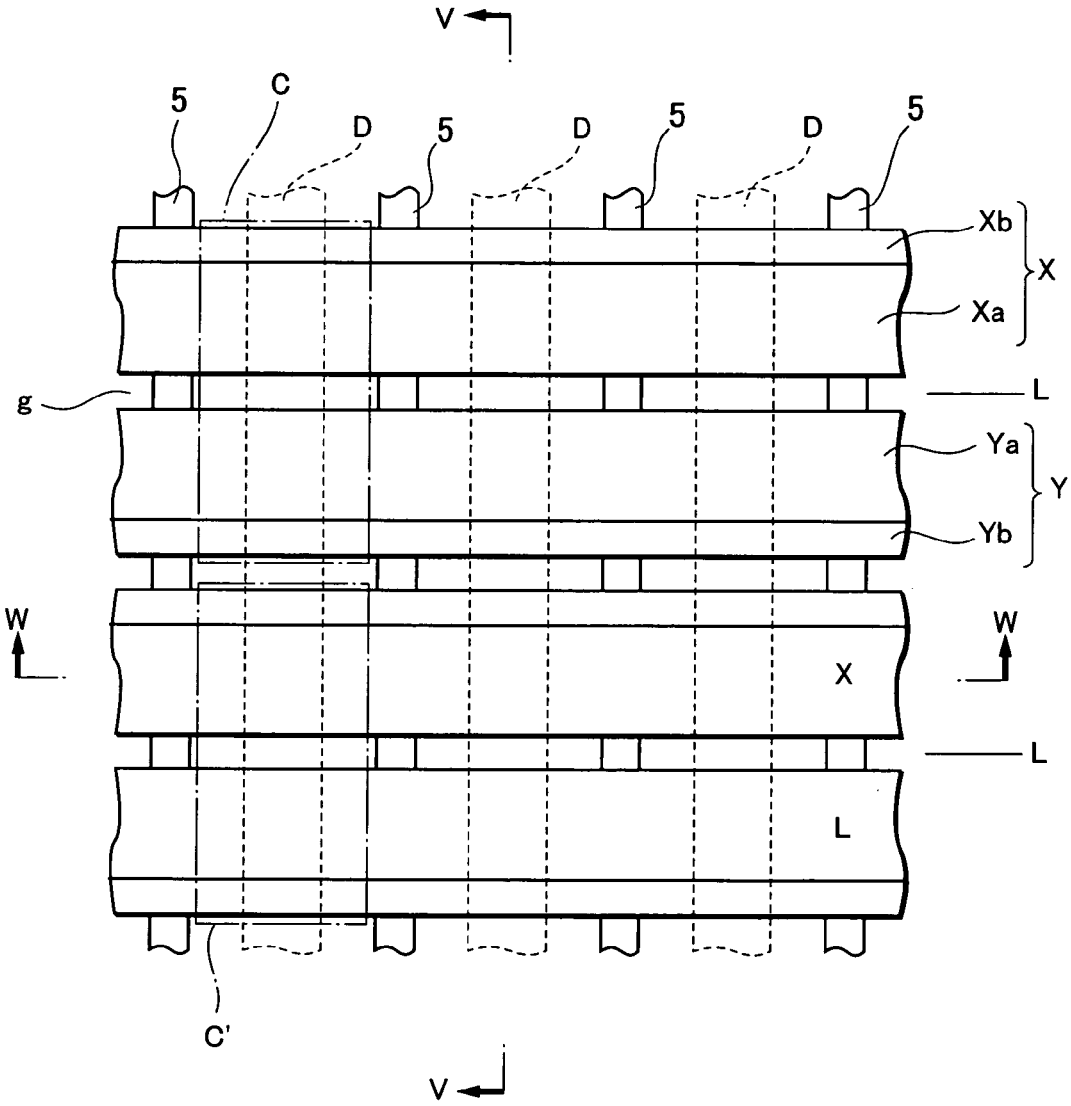
Fig.1 PRIOR ART
FIG. 1 is a schematic front view of the structure of a conventional PDP.
Figure 2:
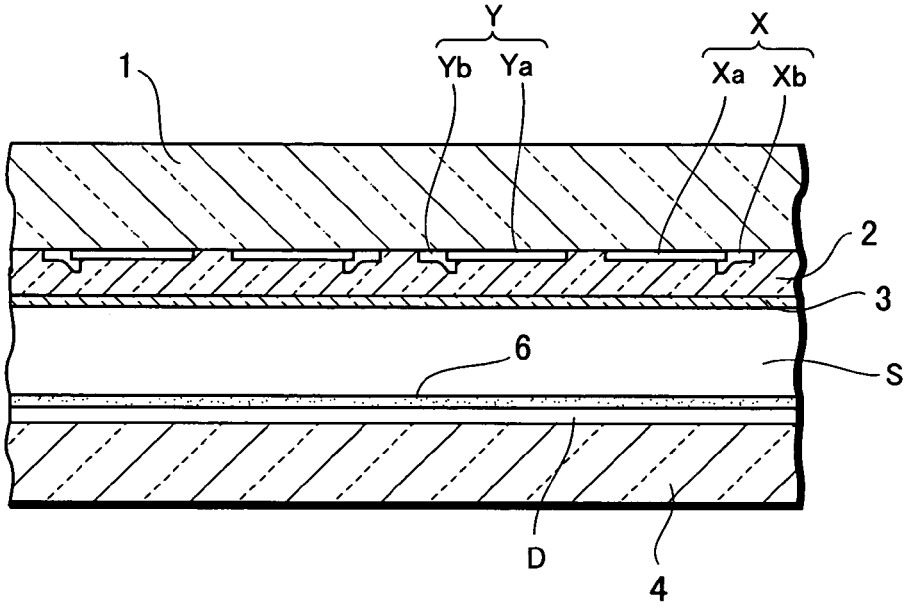
Fig.2 PRIOR ART
FIG. 2 is a sectional view taken along the V—V line in FIG. 1.
Figure 3:
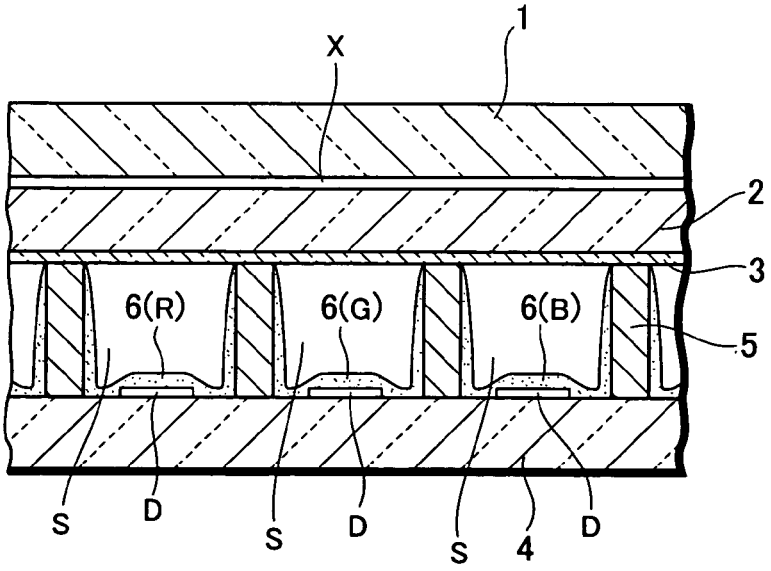
Fig.3 PRIOR ART
FIG. 3 is a sectional view taken along the W—W line in FIG. 1.
Figure 4:
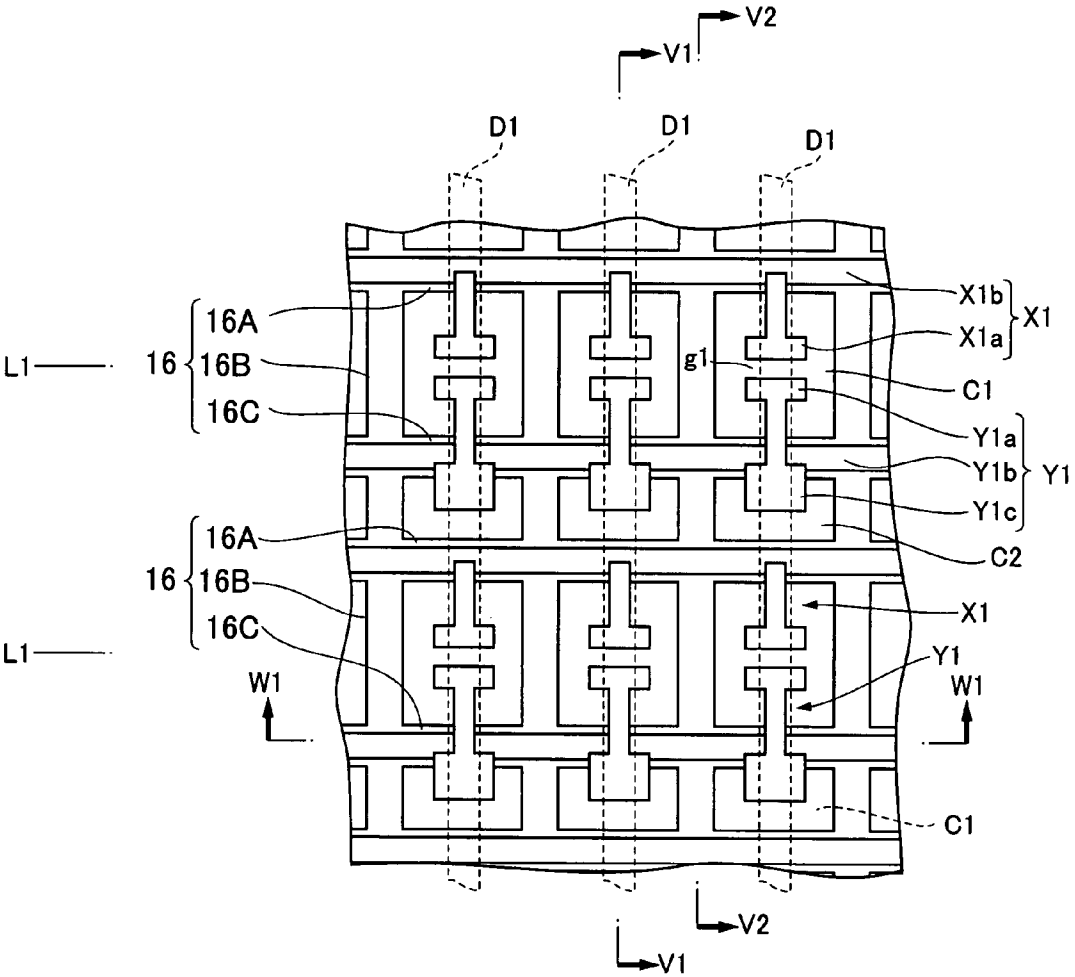
FIG. 4 is a schematic front view illustrating an embodiment according to the present invention.
Figure 5:
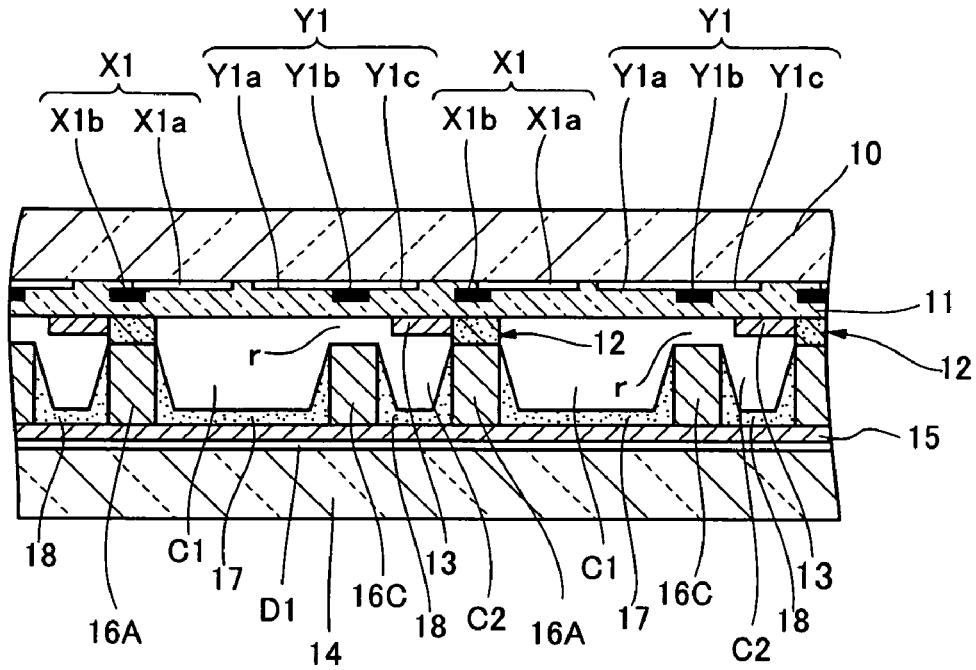
FIG. 5 is a sectional view taken along the V1—V1 line in FIG. 4.
Figure 6:
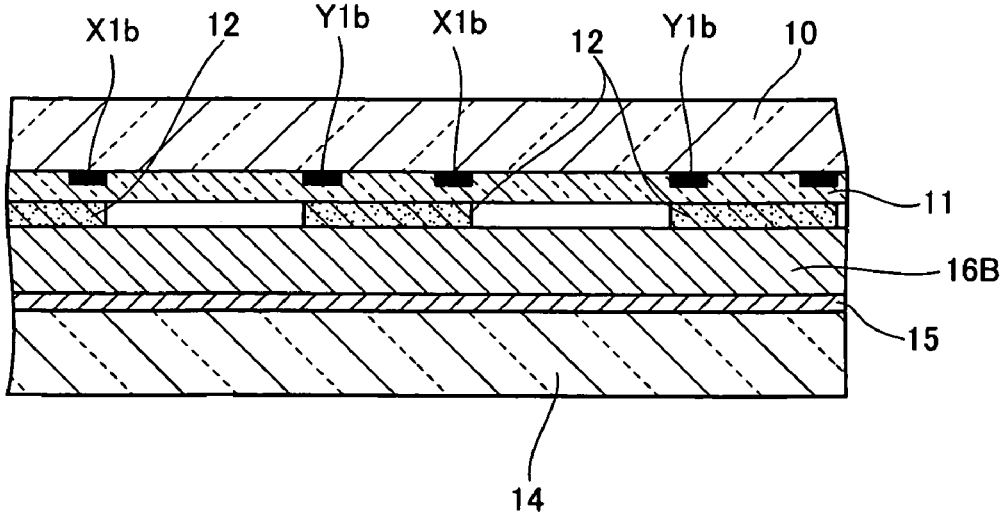
FIG. 6 is a sectional view taken along the V2—V2 line in FIG. 4.
Figure 7:
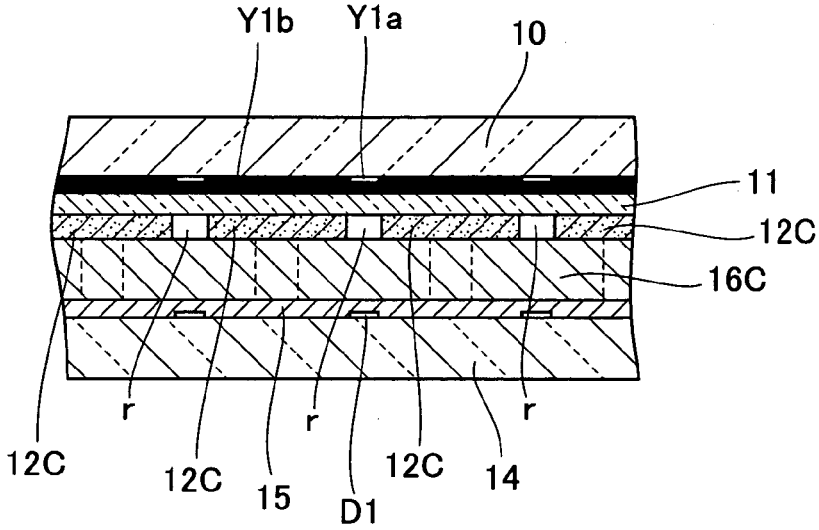
FIG. 7 is a sectional view taken along the W1—W1 line in FIG. 4.

FIG. 4 to FIG. 7 are schematic diagrams illustrating an embodiment of a plasma display panel (hereinafter referred to as "PDP") according to the present invention: FIG. 4 is a front view of a part of the cell structure of the PDP and FIGS. 5, 6 and 7 are sectional views respectively taken along the V1—V1 line, the V2—V2 line and the W1—W1 line as shown in FIG. 4.

The PDP illustrated in FIG. 4 to FIG. 7 has a plurality of row electrode pairs (X1, Y1) each extending in a row direction of a front glass substrate 10 (the right-left direction in FIG. 4) and arranged parallel to each other on the inner surface of the front glass substrate 10 serving as the display screen.

The row electrode X1 is composed of T-shaped transparent electrodes X1*a* formed of a transparent conductive film made of ITO or the like, and a black-colored bus electrode X1*b* formed of a metal film. The bus electrode X1*b* extends in the row direction of the front glass substrate 10 and is connected to the proximal ends (corresponding to the foot of the T shape) of the transparent electrodes X1*a*.

Likewise, the row electrode Y1 is composed of T-shaped transparent electrodes Y1*a* formed of a transparent conductive film made of ITO or the like, a black-colored bus electrode Y1*b* formed of a metal film, and addressing-discharge transparent electrodes Y1*c*. The bus electrode Y1*b* extends in the row direction of the front glass substrate 10 and is connected to the proximal ends (corresponding to the foot of the T shape) of the transparent electrodes Y1*a*. Each of the addressing-discharge transparent electrodes Y1*c* is formed integrally with the transparent electrode Y1*a* and extends from the proximal end of the transparent electrode Y1*a* in the opposite direction to the extension of the transparent electrode Y1*a* with respect to the bus electrode Y1*b*.

The row electrodes X1 and Y1 are arranged in alternate positions in the column direction (i.e. the vertical direction in FIG. 4 and the right-left direction in FIG. 5). The transparent electrodes X1*a* and Y1*a* are lined up along the corresponding bus electrodes X1*b* and Y1*b* at regular intervals and extend in the direction toward the other of the row electrodes of the paired transparent electrodes. The two distal widened-ends (corresponding to the head of the T shape) of the transparent electrodes X1*a* and Y1*a* in the row electrode pair face each other with a discharge gap g1 having a required width in between.

The addressing-discharge transparent electrode Y1*c* of the row electrode Y1 is situated between the bus electrode Y1*b* of the row electrode Y1 concerned and a bus electrode X1*b* of a row electrode X1 in the adjacent row electrode pair (X1, Y1), the bus electrodes Y1*b* and X1*b* being spaced back to back in the column direction.

Each of the row electrode pairs (X1, Y1) forms a display line L1 extending in the row direction.

A dielectric layer 11 is formed on the inner surface of the front glass substrate 10 so as to cover the row electrode pairs (X1, Y1). In turn, an additional dielectric layer 12 is formed on a portion of the inner surface of the dielectric layer 11 opposing the back-to-back bus electrodes X1*b* and Y1*b* of the respective row electrode pairs (X1, Y1) adjacent to each other in the row direction and opposing the area between the back-to-back bus electrodes X1*b* and Y1*b* (in which the addressing-discharge transparent electrode Y1*c* is located).

The additional dielectric layer 12 protrudes from the portion of the dielectric layer 11 toward the rear of the PDP (i.e. in the direction toward the bottom in FIG. 5) and extends along the same direction as that of the extension of the bus electrodes X1*b*, Y1*b*.

Figure 8:
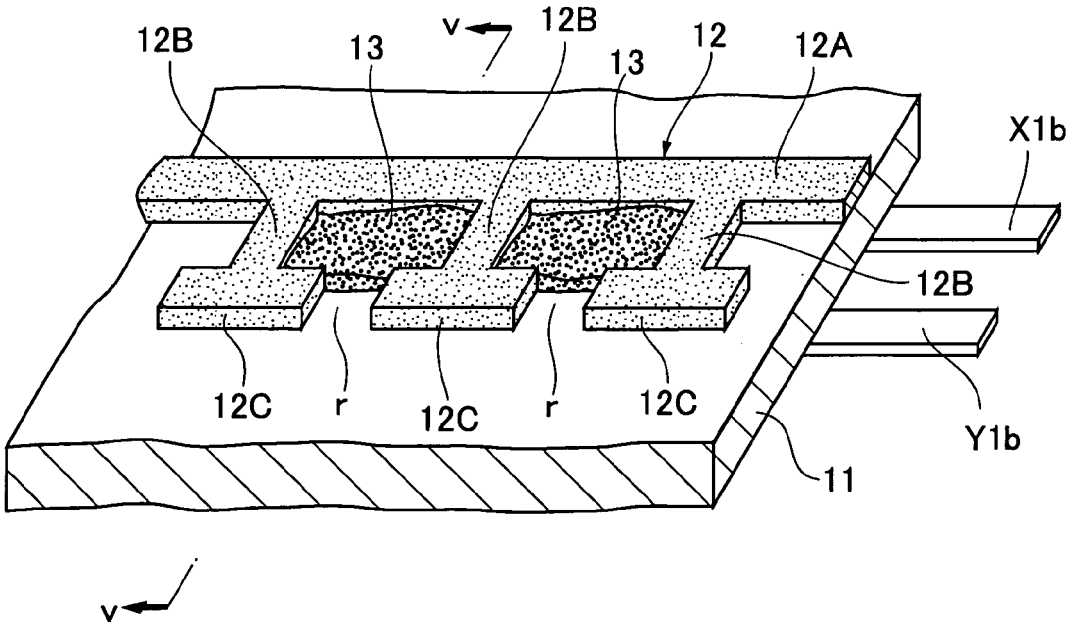
FIG. 8 is a perspective view illustrating the structure of an additional dielectric layer of the embodiment.

FIG. 8 is a perspective view of the shape of the additional dielectric layer 12 when viewed from the inner surface of the front glass substrate 10.

A sectional view of the additional dielectric layer 12 when taken along the v—v line in FIG. 8 is illustrated in FIG. 5.

Each of the additional dielectric layers 12 is constituted of a combination of a first lateral-bar-shaped layer 12A, vertical-bar-shaped layers 12B and second lateral-bar-shaped layers 12C roughly in a ladder shape.

The first lateral-bar-shaped layer 12A of the additional dielectric layer 12 extends opposite the bus electrode X1*b* of the row electrode X1 in the same direction as the bus electrode X1*b* (i.e. in the row direction).

The vertical-bar-shaped layers 12B of the additional dielectric layer 12 are arranged at regular intervals. Each of the vertical-bar-shaped layers 12B is placed close to the bus electrode Y1*b* which is located back to back with the bus electrode X1*b* opposing the first lateral-bar-shaped layer 12A, and opposite to a midway between the addressing-discharge transparent electrodes Y1*c* adjacent to each other in the row direction. The vertical-bar-shaped layer 12B extends from the first lateral-bar-shaped layer 12A in a direction at right angles thereto (i.e. the column direction).

The length between the adjacent vertical-bar-shaped layers 12B has to be equal to the width of a discharge cell in the row direction which will be described later.

Each of the second lateral-bar-shaped layers 12C of the additional dielectric layer 12 is provided opposite to the bus electrode Y1*b* of the row electrode Y1 and at the opposite end of the vertical-bar-shaped layer 12B from the first lateral-bar-shaped layer 12A, and coupled to the vertical-bar-shaped layer 12B so as to form a T shape. The second lateral-bar-shaped layers 12C are lined in the same direction as the extension of the bus electrode Y1*b* at regular intervals, in which a required clearance r is created between the adjacent second lateral-bar-shaped layers 12C.

The additional dielectric layer 12 is constituted of a light absorption layer including a black- or dark-colored pigment.

The inner faces of the dielectric layer 11 and the additional dielectric layer 12 are covered with an MgO made protective layer (not shown).

Further, a high γ material layer 13 is formed in the space almost completely surrounded by the first lateral-bar-shaped layer 12A, the vertical-bar-shaped layers 12B and the second lateral-bar-shaped layers 12C of the additional dielectric layer 12. The high γ material layer 13 is formed of a material having a higher coefficient of secondary electron emission and a lower work function than MgO.

Examples of materials used for forming the high γ material layer 13 include: oxides of alkali metals (e.g. $Cs_2O$: work function 2.3 eV); oxides of alkali-earth metals (e.g. CaO, SrO, BaO); fluorides (e.g. $CaF_2$, $MgF_2$); a material having a coefficient of secondary electron emission increased by means of the use of crystal defects, impurities or the like to give rise to impurity level in crystal (e.g. MgOx having a composition ratio of Mg:O changed from 1:1 to cause crystal defects); $TiO_2$; $Y_2O_3$; and the like.

The front glass substrate 10 is placed parallel to a back glass substrate 14 with a discharge space in between. Then a plurality of column electrodes D1 is arranged parallel to each other at predetermined intervals on the inner surface of the back glass substrate 14 opposing the front glass substrate 10. Each of the column electrodes D1 is positioned opposite to the paired transparent electrodes X1*a* and Y1*a* of each row electrode pair (X1, Y1) and extends in a direction at right angles to the bus electrodes X1*b*, Y1*b* (i.e. the column direction).

The column electrodes D1 are covered with a white-colored column-electrode protective layer (dielectric layer) 15 formed also on the inner face of the back glass substrate 14 opposing the front glass substrate 10. Then a partition wall 16 shaped as described below is formed on the column-electrode protective layer 15.

When viewed from the front glass substrate 10, the partition wall 16 is constituted of: first lateral walls 16A each positioned opposite the bus electrode X1*b* of each row electrode X1 and extending in the row direction; vertical walls 16B each extending in the column direction between the adjacent transparent electrodes X1*a* and the adjacent transparent electrodes Y1*a* which are lined up at regular intervals along the corresponding bus electrodes X1*b*, Y1*b* of the row electrodes X1, Y1; and second lateral walls 16C each positioned opposite the bus electrode Y1*b* of each row electrode Y1 and extending parallel to the first lateral wall 16A with a required spacing in between.

The height of the first lateral wall 16A, vertical wall 16B and second lateral wall 16C is designed to be equal to the spacing between the protective layer covering the inner face of the additional dielectric layer 12 and the column-electrode protective layer 15 covering the column electrodes D1.

Because of this design, the front face of the first lateral wall 16A of the partition wall 16 (the upper face in the FIG. 5) is in contact with the protective layer covering the first lateral-bar-shaped layer 12A of the additional dielectric layer 12. The vertical wall 16B is in contact with the protective layer covering the vertical-bar-shaped layer 12B. Then the second lateral wall 16C is in contact with the protective layer covering the second lateral-bar-shaped layer 12C.

The first lateral walls 16A, vertical walls 16B and second lateral walls 16C of the partition wall 16 partition the discharged space defined between the front glass substrate 10 and the back glass substrate 14 so as to form display discharge cells C1. Each of the display discharge cells C1 corresponds to the area opposite to the paired transparent electrodes X1*a* and Y1*a* facing each other.

Further, a space is created between the first lateral wall 16A and the second lateral wall 16C and opposite to the area between the back-to-back bus electrodes X1*b* and Y1*b* of the row electrode pairs (X1, Y1) adjacent to each other. This space is divided by the vertical walls 16B into addressing discharge cells C2. Thus, the display discharge cells C1 and the addressing discharge cells C2 are arranged in alternate positions in the column direction.

Each of the addressing discharge cells C2 is opposite the addressing-discharge transparent electrode Y1*c* of the row electrode Y1.

The display discharge cell C1 and the addressing display cell C2 adjacent to each other with the second lateral wall 16C in between in the column direction communicate by means of the clearance r formed between the adjacent second lateral-bar-shaped layers 12C of the additional dielectric layer 12.

In each display discharge cell C1, a phosphor layer 17 covers almost all five faces facing the discharge space, i.e. the face of the column-electrode protective layer 15 and the side faces of the first lateral wall 16A, vertical walls 16B and second lateral wall 16C of the partition wall 16. The red (R), green (G) and blue (B) colored phosphor layers 17 are individually formed in the display discharge cells C1 so that red (R), green (G) and blue (B) colors are arranged in order in the row direction.

In each addressing discharge cell C2, an MgO layer 18 covers almost all five faces facing the discharge space, i.e. the face of the column-electrode protective layer 15 and the side faces of the first lateral wall 16A, vertical walls 16B and second lateral wall 16C.

The display discharge cells C1 and the addressing discharge cells C2 are filled with a xenon-including discharge gas.

The aforementioned PDP generates images as follows.

First, in a reset period, a reset discharge is produced between the column electrode D1 and the transparent electrode Y1*a* of the row electrode Y1 in each display discharge cell C1. Through the reset discharge, wall charges are generated on the surface of the dielectric layer 11 (or alternatively, the wall charges accumulated on the surface of the dielectric layer 11 are erased).

At this point, in the addressing discharge cell C2, a discharge is also produced between the column electrode D1 and the addressing discharge transparent electrode Y1*c* of the row electrode Y1. The discharge induces emission of a 147 nm-wavelength vacuum ultraviolet light from xenon included in the discharge gas. The vacuum ultraviolet light excites the high γ material layer 13 facing toward the addressing discharge cell C2. Thereupon, secondary electrons (priming particles) are released from the high γ material layer 13 into the addressing discharge cell C2.

The vacuum ultraviolet light emitted from xenon also induces the release of secondary electrons (priming particles) from the MgO layer 18. However, the amount of secondary electrons (priming particles) released from the high γ material layer 13 is larger than that from the MgO layer 18. This is because the high γ material layer 13 is formed of the materials having a higher coefficient of secondary electron emission and a lower work function than those of MgO included in the MgO layer 18.

In an addressing period following the reset period, selectively, scan pulses are applied to the row electrodes Y1 and data pulses are applied to the column electrodes D1, so that in each of the selected addressing discharge cells C2, an addressing discharge is produced between the addressing discharge transparent electrode Y1*c* of the row electrode Y1 receiving the application of the scan pulse and the column electrode D1 receiving the application of the data pulse.

At this point, because an abundance of secondary electrons (priming particles) has been released from the high γ material layer 13 into the addressing discharge area C2 during the reset period prior to the addressing period, the addressing discharge is produced at low voltage, and also the fast addressing is implemented.

The charged particles generated in the addressing discharge cell C2 through the addressing discharge flow through the clearance r formed between the second lateral-bar-shaped layers 12C of the additional dielectric layer 12, and then enter the display discharge cell C1 adjacent to the addressing discharge cell C2 concerned with the second lateral wall 16C in between.

Thus, the wall charges accumulated on the portion of the dielectric layer 11 facing the display discharge cell C1 become erased (or alternatively wall charges become generated on the dielectric layer 11), whereby lighted cells (the display discharge cells C1 having the wall charges generated on the dielectric layer 11) and non-lighted cells (the display discharge cells C1 having no wall charges generated on the dielectric layer 11) are distributed in all the display lines L1 in accordance with the image to be generated.

In a sustaining emission period subsequent to the addressing period, simultaneously in all the display lines L1, a discharge-sustaining pulse is applied alternately to the row electrodes X1 and Y1 in each row electrode pair (X1, Y1). Thereupon, in each lighted cell, a sustain discharge is produced between the transparent electrodes X1*a* and Y1*a* facing each other with every application of the discharge-sustaining pulse.

As a result of the sustain discharge, ultraviolet light is generated and excites each of the red (R), green (G) and blue (B) phosphor layers 17 formed in the individual display discharge cells Cl to allow the phosphor layers 17 to emit visible light for the generation of the image.

In the foregoing PDP, the addressing discharge for distributing the lighted cells and the non-lighted cells over the panel surface in accordance with the image to be displayed is caused in the discharge cell provided independently of the discharge cell for producing the sustain discharge for allowing the phosphor layer 17 to emit color light. This design eliminates the conventional circumstance where an addressing discharge produced passes through the phosphor layer.

As a result, it is possible to provide the stable addressing discharge properties which are not subject to influences related to the phosphor layer such as discharge properties varying with each color of the phosphor material, variations in the layer thickness produced in the forming process for the phosphor layer, and the like.

With the foregoing PDP, in the reset period, an abundance of secondary electrons is released from the high γ material layer 13 formed of the materials having a higher coefficient of secondary electron emission and a lower work function (e.g. work function: 4.2 eV) than those of MgO (work function: 4.2 eV) used for forming the protective layer. Hence the necessary amount of priming particles for producing the addressing discharge is ensured. The priming particles thus adequately ensured have the effect of lowering the voltage required for starting the addressing discharge and therefore make it possible to produce an addressing discharge at low voltage at high speed.

Further, the high γ material layer 13 is provided facing toward the addressing discharge cell C2 in which visible light is not generated for the generation of image, so that light transmittance through the secondary electron emissive layer presents no problem. Accordingly, the range of choices of materials for forming the high γ material layer 13 is extended.

For example, there is no need to form MgO having a high light-transmittance by use the vacuum evaporation techniques or the like such as forming the protective layer facing the display discharge cell C1. This makes it possible to select a material having a high coefficient of secondary electron emission and a low work function and even a low light-transmittance. Further, the mixing of a black-, or dark-colored pigment into the high γ material layer 13 makes it possible to prevent the light generated in the addressing discharge cell C2 by means of the discharge from leaking toward the display screen of the front glass substrate 10, and also prevent the reflection of ambient light incident upon the area (non-display zone) of the front glass substrate 10 opposing the addressing discharge cells C2.

In the PDP of the embodiment, charged particles generated by means of an addressing discharge in the addressing discharge cell C2 flow via the clearance r formed directly next to the high γ material layer 13 (see FIGS. 7 and 8) into the display discharge cell C1 paired with the addressing discharge cell C2 in which the addressing discharge has been produced. At this point, the addressing discharge cell C2 is blocked from the unconnected display discharge cell C1 positioned back to back therewith in the column direction, and from the unconnected addressing discharge cells C2 positioned on both sides thereof in the row direction because the first lateral-bar-shaped layer 12A and the vertical-bar-shaped layer 12B of the additional dielectric layer 12 are in individual contact with the first lateral wall 16A and the vertical wall 16B of the partition wall 16. For this reason, the charged particles are prevented from flowing into those unconnected display discharge cell C1 and addressing discharge cells C2.

Charged particles generated by means of a sustain discharge in the display discharge cell C1 are also prevented from flowing the unconnected addressing discharge cell C2 by the additional dielectric layer 12.

Figure 9:
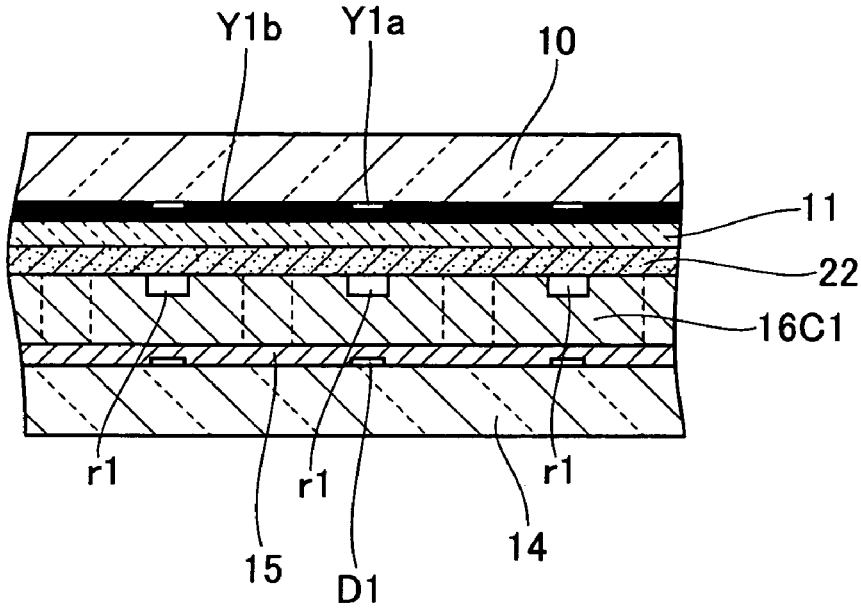
FIG. 9 is a sectional view illustrating a modification in the communicating path according to the present invention.

The PDP described in the embodiment is structured to cause the charged particles to pass through the clearance r formed in the additional dielectric layer 12 (see FIGS. 7 and 8) when the charged particles flow from the addressing discharge cell C2 into the display discharge cell C1. However, as in shown in FIG. 9, a groove r1 may be formed in a second lateral wall 16C1 to allow the charged particles to flow through the groove r1 into the display discharge cell C1. In this case, an additional dielectric layer 22 is formed in a complete ladder shape.

Figure 10:
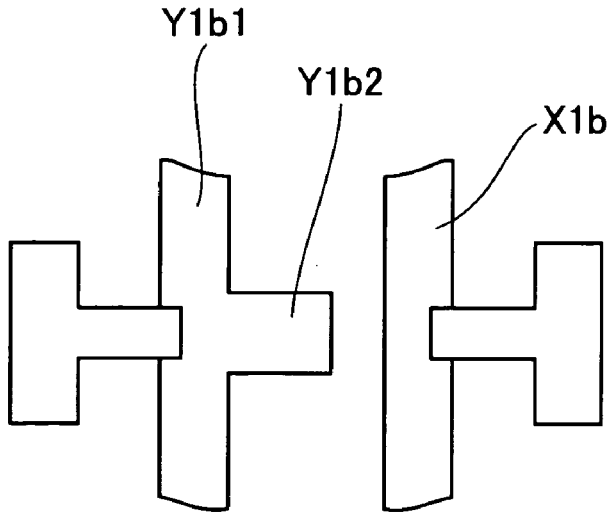
FIG. 10 is a front view illustrating a modification in the row electrode according to the present invention.

In the PDP of the embodiment, a discharge in the reset period and an addressing discharge in the addressing discharge cell C2 are produced by use of the addressing discharge transparent electrode Y1*c* extending from the transparent electrode Y1*a* of the row electrode Y1 to a point facing the addressing discharge cell C2. However such discharge in the addressing discharge cell C2 may be produced by another method. For example, as illustrated in FIG. 10, a bus electrode Y1*b*1 may have a projection Y1*b*2 projecting from the side edge of the bus electrode Y1*b*1 toward the bus electrode X1*b* in the row electrode pair (X1, Y1) adjacent thereto to a position opposing the addressing discharge cell C2. The projection Y1*b*2 may be used to produce a discharge in the reset period and an addressing discharge.

In the PDP of the embodiment, the additional dielectric layer 12 is not necessary required to be formed to serve as the light absorption layer including a black- or dark-colored pigment. However, the form of the additional dielectric layer 12 serving as the light absorption layer including a black- or dark-colored pigment makes it possible to prevent light emission caused by an addressing discharge in the addressing discharge cell C2 from leaking toward the display screen of the front glass substrate 10, and also prevent the reflection of ambient light passing through the front glass substrate 10 to be incident upon the area corresponding to the addressing discharge cells C2 (non-display zone), resulting in a further improvement in contrast on a displayed image.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel comprising:

a front substrate having an inner face and a back substrate having an inner face opposing the inner face of the front substrate with a discharge space in between;

a plurality of row electrode pairs extending in a row direction and regularly arranged in a column direction to form display lines on the inner face of the front substrate;

a dielectric layer covering the row electrode pairs on the inner face of the front substrate;

a protective layer covering the dielectric layer on the inner face of the front substrate;

a plurality of column electrodes extending in the column direction and regularly arranged in the row direction to intersect with the row electrode pairs;

a partition wall having dividing walls;

unit light-emission areas formed at the intersections of the row electrode pairs and the column electrodes in the discharge space, and each defined by the partition wall, and each partitioned by the dividing wall into a first discharge area facing mutually opposing portions of the row electrodes constituting each of the row electrode pairs and providing for a discharge produced between the row electrodes, and a second discharge area facing a portion of one row electrode in the row electrode pair initiating a discharge in association with the column electrode and providing for the discharge produced between the column electrode and the portion of the one row electrode;

a communicating element provided between the first discharge area and the second discharge area for communication from the second discharge area to the first discharge area; and a secondary electron emissive layer formed of a material of a coefficient of secondary electron emission higher than that of the protective layer and provided on a portion of an inner face of the dielectric layer facing the second discharge area.

2. A plasma display panel according to claim 1, further comprising an additional portion provided on a portion of an inner face of the dielectric layer facing the second discharge area, and formed in contact with the partition wall, protruding from the back substrate and defining the unit light-emission areas, to block the second discharge area from the unconnected unit-light emission areas adjacent to the second discharge area, wherein the secondary electron emissive layer is formed in a recess formed by the additional portion.

3. A plasma display panel according to claim 2, wherein the additional portion includes one of a black-colored light absorption layer and a dark-colored light absorption layer.

4. A plasma display panel according to claim 1, wherein one of a black-colored pigment and a dark-colored pigment is mixed into the secondary electron emissive layer.

5. A plasma display panel according to claim 1, wherein each of the row electrodes constituting the row electrode pair has an electrode body extending in the row direction, and transparent electrode portions each extending from the electrode body in the column direction for each unit light-emission area, and each facing the other of the paired transparent electrode portions of the paired row electrodes with a discharge gap in between in an area opposing the first discharge area; and wherein the transparent electrode portion of the one row electrode in the row electrode pair initiating a discharge in association with the column electrode extends in the direction opposite to the other row electrode of the paired row electrodes to form a projecting portion and a discharge is produced between the projecting portion of the transparent electrode and the column electrode in the second discharge area.

6. A plasma display panel according to claim 1, wherein each of the row electrodes constituting the row electrode pair has an electrode body extending in the row direction, and transparent electrode portions each extending from the electrode body in the column direction for each unit light-emission area, and each facing the other of the paired transparent electrode portions of the paired row electrodes with a discharge gap in between in an area opposing the first discharge area; and wherein a portion of the electrode body of the one row electrode in the row electrode pair initiating a discharge in association with the column electrode extends in the direction opposite to the other row electrode of the paired row electrodes, and a discharge is produced between the portion of the electrode body and the column electrode in the second discharge area.

7. A plasma display panel according to claim 2, wherein the communication element comprises a clearance formed in a portion of the additional portion opposing the dividing wall provided a partition between the first discharge area and a second discharge area.

8. A plasma display panel according to claim 1, wherein the communication element comprises a groove formed in the dividing wall provided a partition between the first discharge area and a second discharge area.

9. A plasma display panel according to claim 1, further comprising a phosphor layer formed in only the first discharge area and emitting light by means of a discharge.

10. A plasma display panel according to claim 1, further comprising an MgO layer formed on the back substrate in the second discharge area.

* * * * *